United States Patent [19]

Price

[11] Patent Number: 5,048,480

[45] Date of Patent: Sep. 17, 1991

[54] VARIABLE TIMING PROCESS AND MECHANISM FOR A COMPRESSION RELEASE ENGINE RETARDER

[75] Inventor: Robert B. Price, Manchester, Conn.

[73] Assignee: Jacobs Brake Technology Corporation, Wilmington, Del.

[21] Appl. No.: 493,968

[22] Filed: Mar. 15, 1990

[51] Int. Cl.[5] ..... F02D 9/06; F02D 13/04

[52] U.S. Cl. ..... 123/321; 123/90.16

[58] Field of Search ..... 123/321, 322, 90.15, 123/90.16

[56] References Cited

U.S. PATENT DOCUMENTS

| | | | |
|---|---|---|---|
| 3,220,392 | 11/1965 | Cummins | 123/97 |
| 4,384,558 | 5/1983 | Johnson | 123/321 |
| 4,398,510 | 8/1983 | Custer | 123/90.16 |
| 4,475,500 | 10/1984 | Bostelman | 123/321 |
| 4,648,365 | 3/1987 | Bostelman | 123/321 |
| 4,655,178 | 4/1987 | Meneely | 123/321 |
| 4,664,070 | 5/1987 | Meistrick et al. | 123/321 |
| 4,706,625 | 11/1987 | Meistrick et al. | 123/321 |
| 4,898,128 | 2/1990 | Meneely | 123/321 |

*Primary Examiner*—Tony M. Argenbright
*Assistant Examiner*—Robert E. Mates
*Attorney, Agent, or Firm*—Robert R. Jackson

[57] ABSTRACT

A process and apparatus are provided to maximize the retarding horsepower of a compression release engine retarder driven from the intake or exhaust valve pushtubes or the fuel injector pushtubes throughout the operating speed range of the engine without exceeding the maximum allowable loading of the pushtubes. The apparatus includes a timing advance mechanism incorporated into each slave piston comprising a biasing means responsive to the hydraulic pressure above the slave piston which determines the position of a moveable stop means whereby the timing advance of the slave piston is continuously varied in response to the hydraulic pressure above the slave piston. The process includes the steps of reducing the flow of fuel to the cylinder, increasing the hydraulic pressure above the slave piston, compressing a biasing means in response to the hydraulic pressure above the slave piston, and moving a stop means relative to the slave piston in response to the compression of the biasing means thereby continuously varying the timing advance of the slave piston.

20 Claims, 8 Drawing Sheets

VARIABLE TIMING PROCESS AND MECHANISM FOR A COMPRESSION RELEASE ENGINE RETARDER

BACKGROUND OF THE INVENTION

1. Field of the Invention

This invention relates generally to the field of engine retarders and more particularly to engine retarders wherein the exhaust valves of the engine are opened near the top dead center on the compression stroke of the engine so that the energy absorbed by the engine during the compression stroke is not returned to the engine during the expansion stroke. Such an engine retarder is known as a compression release engine retarder. The present invention relates specifically to a variable timing mechanism for an engine retarder of the above type.

2. Prior Art

For many years it has been recognized that the ordinary wheel braking mechanisms, commonly of the disc or drum type fitted to commercial vehicles, while capable of absorbing a large amount of energy during a short period, are incapable of absorbing the somewhat lesser amounts of energy required during an extended period of time, for example, during descent of a long but gradual decline. In such circumstances, the friction material used in the brake mechanism will become overheated (causing "brake fading") and may be destroyed while the metal parts may warp or buckle. In general, the problem has been resolved either by using a lower gear ratio so that the engine can function more effectively as a brake due to its internal friction or by employing some form of an auxiliary braking system. A number of such auxiliary braking systems, generally known as engine retarders, have been developed by the art, including hydrokinetic retarders, exhaust brakes, electric brakes, and gas compression release retarders. In each of these systems, a portion of the kinetic energy of the vehicle is transformed into heat as a result of gas compression, fluid friction, or electrical resistance and, thereafter, dissipated to the atmosphere directly or through the vehicle exhaust or cooling system. The common characteristic of such auxiliary braking systems is the ability to absorb and dissipate a certain amount of power continuously or at least for an indefinite but relatively long period of time.

The hydrokinetic and electric retarders are generally quite heavy and bulky since they require turbine or dynamo mechanisms and thus may be undesirable from the viewpoint of initial cost as well as operating cost. The exhaust brake, while generally simple and compact, necessarily increases the exhaust manifold pressure and may occasion "floating" of the exhaust valves of the engine, a generally undesirable condition.

It has long been recognized that in the ordinary operation of an internal combustion engine employing the Otto or Diesel cycle, for example, a considerable amount of work is done during the compression stroke upon the air or air/fuel mixture introduced into the cylinder. During the expansion or power stroke of the engine the work of compression is recovered so that, neglecting friction losses, the net work due to compression and expansion is zero and the net power output is that resulting from the combustion of the air/fuel mixture. When the throttle is closed or the fuel supply interrupted, the engine will, of course, function as a brake to the extent of the friction inherent in the engine mechanism.

Many attempts have been made to increase the braking power of an engine by converting the engine into an air compressor and dumping the compressed air through the exhaust system. A simple and practical method of accomplishing this end is disclosed in Cummins U.S. Pat. No. 3,220,392. In that patent an auxiliary exhaust valve actuating means synchronized with the engine crankshaft is provided which opens the exhaust valve near the end of the compression stroke, without interfering with the normal actuating cam means for the exhaust valve, together with appropriate control means for the auxiliary exhaust valve actuator. While the engine retarding means set forth in detail in the Cummins U.S. Pat. No. 3,220,392 is capable of producing a retarding power approaching the driving power of the engine under normal operating conditions, experience with this mechanism has revealed that the retarding power may be affected significantly by the timing of the opening of the engine exhaust valve.

If the exhaust valve is opened too late a significant portion of the retarding power may be lost due to the expansion of the compressed air during the initial part of the expansion stroke. On the other hand, if the exhaust valve is opened too early, there may be insufficient compression during the compression stroke which, similarly, will reduce the amount of retarding power that can be developed.

The timing of the exhaust valve opening is affected to a significant degree by the temperature conditions in the engine which vary as a result of changes in operating conditions. It will be appreciated, for example, that the length of the engine exhaust valve stem will increase with increases in temperature, thereby reducing clearance or "lash" in the exhaust valve actuating mechanism, i.e., the exhaust valve train. While it is known to provide adjustable elements in the valve actuating mechanism by means of which the clearance may be set (see, for example, U.S. Pat. No. 3,220,392, FIG. 2, element 301), the clearance as determined by the rocker arm adjusting screw (or equivalent element) must be at least large enough when the engine is cold so that some clearance will remain when the engine is hot. If there is inadequate clearance when the engine is hot, the exhaust valve may be held in a partially open condition. In this circumstance, the operations of the engine may be affected adversely and the exhaust valves are apt to be burned. To avoid such effects, it is common to provide a clearance on the order of 0.018 inch in the exhaust valve actuating mechanism.

In Custer U.S. Pat. No. 4,398,510 a timing advance mechanism is disclosed which automatically changes the valve train lash from the engine operating mode value, i.e., 0.018 inch cold adjustment, to a lesser or negative amount when the engine is in the retarding mode. The hydro-mechanical mechanism of U.S. Pat. No. 4,398,510 is incorporated into the slave piston adjusting screw and comprises an hydraulic piston which automatically extends a predetermined distance from the adjusting screw body whenever the engine is placed in the retarding mode and high pressure is generated in the retarder hydraulic system. The mechanism of U.S. Pat. No. 4,398,510 is capable of modifying the exhaust train cold clearance by any particular predetermined amount and this increases the retarding horsepower developed by the engine, the increase being greater at higher engine speeds.

Since the development of the mechanism of U.S. Pat. No. 4,398,510, truck operators have sought to decrease the level of pollutants emitted by the internal combustion engine and to increase the fuel economy of the engine by de-tuning the engine and lowering the engine speed. Although these engine operating conditions are effective for their intended purposes, they reduce the operating effectiveness of the compression release engine retarder. As a result, a need is presented for an engine retarder with improved retarding performance.

SUMMARY OF THE INVENTION

In accordance with the present invention, applicant has discovered that the desired timing advance for maximizing retarder performance varies with engine speed and, further, that the pressure within the high pressure system of the engine retarder is proportional to the cylinder pressure and is a function of engine speed. Since the force required to open the exhaust valves of the engine also varies with the cylinder pressure, the load imposed on the portions of the valve train or injector train mechanisms used to open the exhaust valves is also a function of the housing pressure. Applicant has discovered that means responsive to housing pressure may be incorporated into the slave piston whereby the timing advance may be adjusted automatically in response to housing pressure so that maximum retarding horsepower may be developed without exceeding the allowable load which may be carried by the valve train or injector train mechanisms. The means responsive to housing pressure may be a biasing means such as a Belleville washer or a coil spring or a wave washer, an elastomeric body formed from natural or synthetic rubber, or a gas or liquid having an appropriate bulk modulus contained in a diaphragm or other closed system. The means responsive to housing pressure are incorporated into the slave piston so as to change the effective length of a protrusion from the slave piston thereby modifying the timing of the exhaust valve opening when the engine is in the retarding mode. The invention also comprises a process of compression release engine retarding wherein the retarding horsepower is maximized within the load carrying capacity of the valve train or injector train mechanisms by varying the timing advance in response to housing pressure. In an engine having a nominal valve train lash or clearance of about 0.018 inch, the optimum lash or clearance during the retarding mode may vary from −0.006 inch at maximum engine speed to +0.006 inch at minimum engine speed. While it may not be possible to obtain the optimum lash at all engine speeds, Applicant's method and apparatus are effective to approach the optimum lash over a substantial portion of the operating speed range of the engine.

DESCRIPTION OF THE DRAWINGS

Further objects and advantages of the invention will become apparent from the following detailed description of the invention and the accompanying drawings in which.

DETAILED DESCRIPTION OF THE INVENTION

Figure 1:
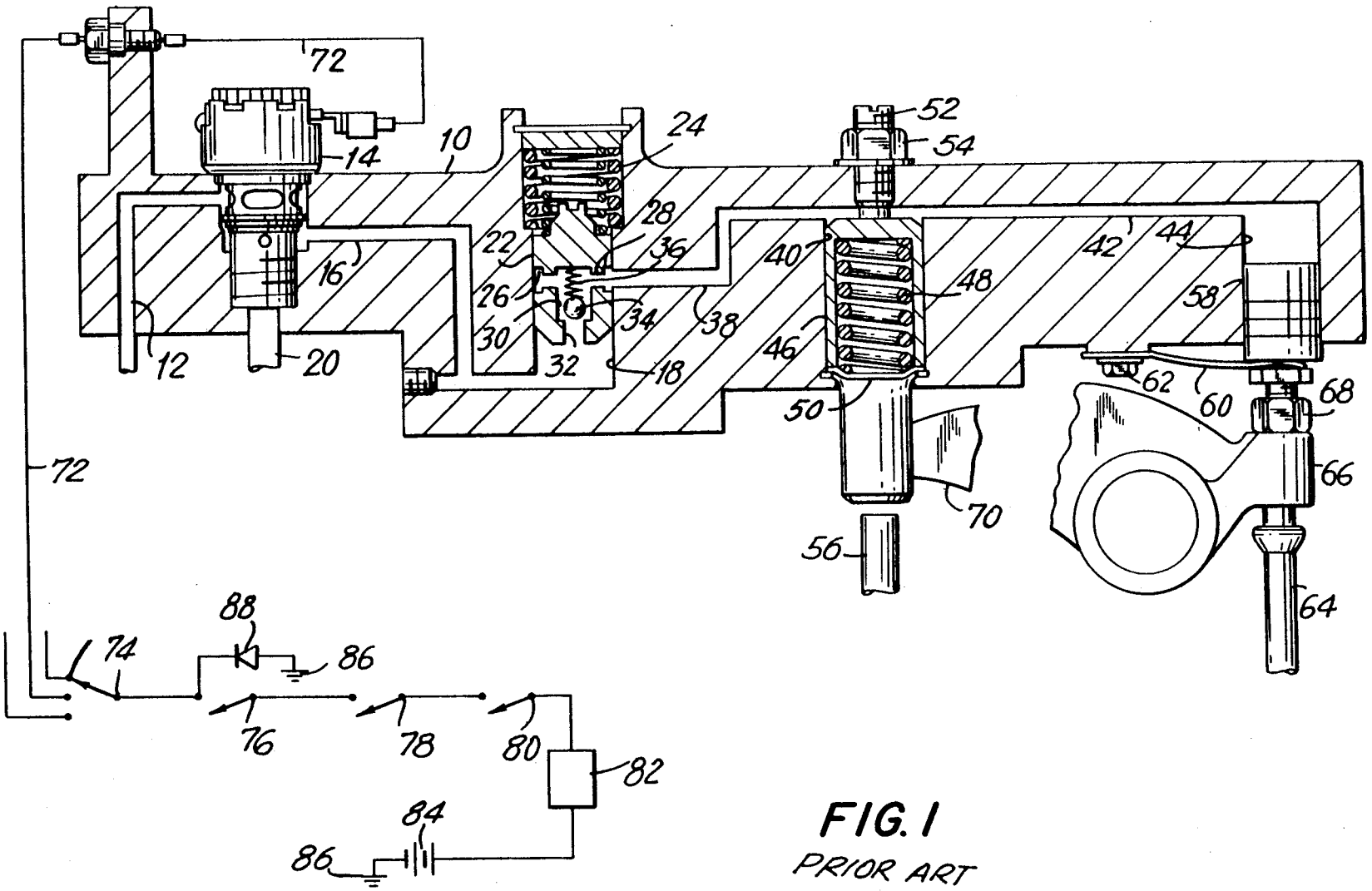
FIG. 1 PRIOR ART
FIG. 1 is a schematic view of a compression release engine retarder in which the present invention may be incorporated.

Reference is first made to FIG. 1 which illustrates, in schematic form, a conventional compression release retarder for a diesel engine. Numeral 10 indicates the retarder housing which is fastened to the engine head. Depending upon the specific design of the engine, two, three or more housings may be employed though, normally, one housing may service two or three cylinders of a six cylinder engine. Oil is drawn from the pressurized oil supply of the engine (not shown) through a supply passageway 12 into a three-way solenoid valve 14. Whenever the solenoid valve 14 is energized, oil may pass through the solenoid valve into delivery passageway 16 which interconnects the solenoid valve 14 and control valve cylinder 18. The solenoid valve 14 is provided with a drain passageway 20 which communicates with delivery passageway 16 when the solenoid valve is deenergized and allows oil to drain back into the engine oil supply.

A control valve 22 is mounted for reciprocating motion within the control valve cylinder 18 and biased downwardly (as shown in FIG. 1) toward a closed position by coil springs 24. A circumferential groove 26 is formed on the outer surface of the control valve 22 and communicates via a diametral bore 28 with a check valve chamber 30. An axial bore 32 communicates between the check valve chamber 30 and the control valve cylinder 18. A check valve 34 is located within the check valve chamber 30 and biased toward a closed position sealing off the axial bore 32 by a spring 36. In its uppermost and open position, the circumferential groove 26 of the control valve 22 registers with passageway 38 which, in turn, communicates with slave cylinder 40. Passageway 42 communicates between slave cylinder 40 and master cylinder 44.

Figure 2:
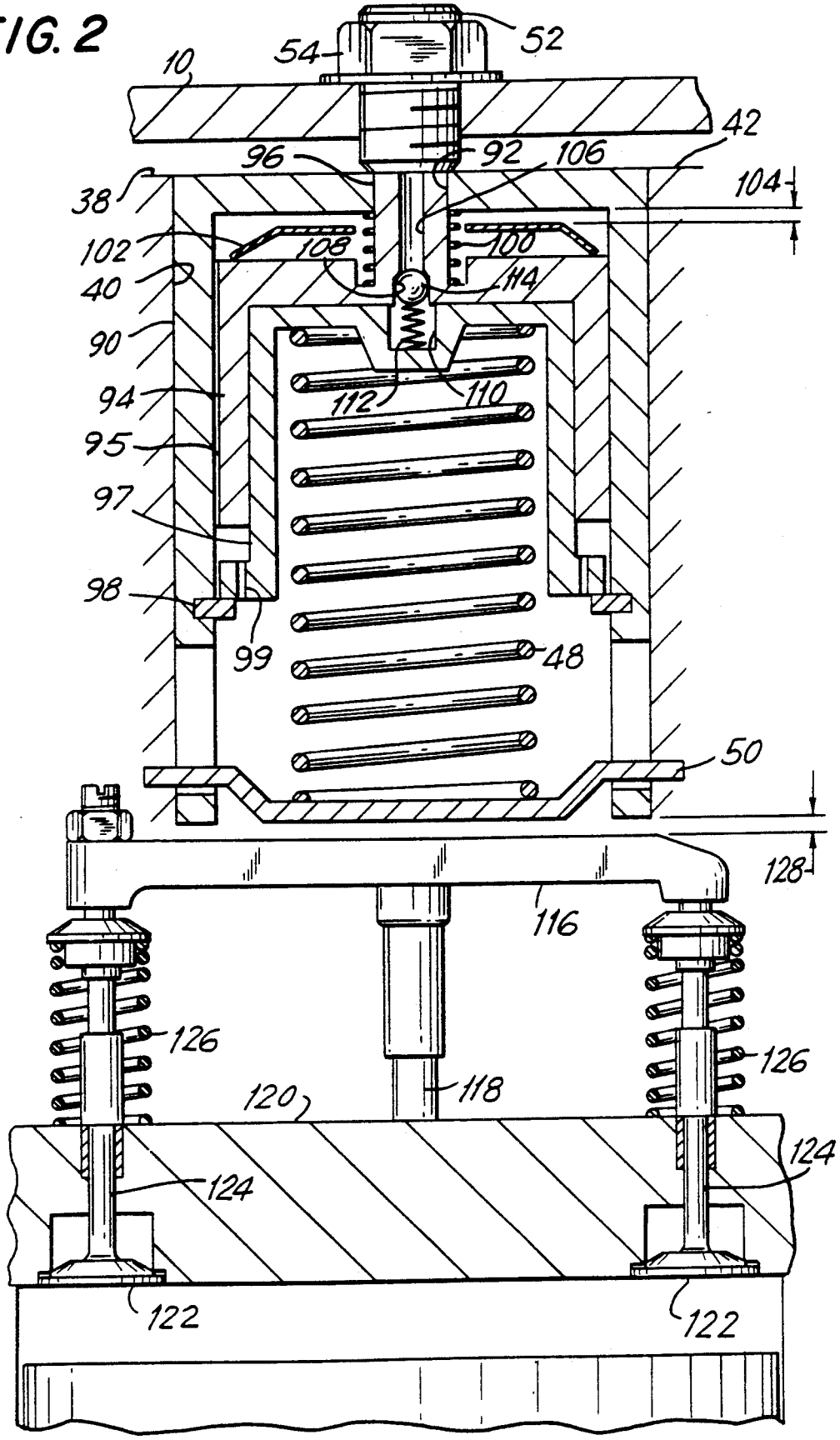
FIG. 2 is an enlarged fragmentary view of the slave piston and cylinder in accordance with the present invention, together with the crosshead and engine exhaust valves showing the relative position of the parts during the powering mode of engine operation.

A slave piston 46 is mounted for reciprocating motion in slave cylinder 40 and biased in an upward direction (as shown in FIG. 1) by a compression spring 48 which seats against a bracket 50 fixed in the housing 10. The upper or rest position of the slave piston 46 is adjustably determined by an adjusting screw 52 threaded into the retarder housing 10 and fixed in its adjusted position by a locknut 54. The slave piston 46 may be aligned with the stem 56 of the engine exhaust valve or, as shown in FIG. 2, may be aligned with the exhaust valve cross-head in engines fitted with dual exhaust valves.

A master piston 58 is mounted for reciprocating motion within the master cylinder 44 and biased in an upward direction (as shown in FIG. 1) by a light leaf spring 60 affixed to the retarder housing 10 by screw means 62. The master piston 58 is aligned with a push-tube 64 which may be driven by an exhaust or intake valve cam or by the fuel injector cam. The pushtube 64 is associated with the corresponding rocker arm 66 which is provided with an adjusting screw mechanism 68 which, in turn, contacts the master piston 58. As is well-known, if an injector pushtube is selected to drive the mechanism, it will be associated with the same cylinder as is the exhaust valve stem 56. If the exhaust valve or intake valve pushtube is selected to drive the mechanism, it will be associated with a cylinder remote from that cylinder associated with exhaust valve stem 56. Those skilled in the art will understand that any pushtube 64 which moves upwardly (as shown in FIG. 1) during the compression stroke of the cylinder with which exhaust valve stem 56 is associated may be selected for the driving function. A fragment of the exhaust valve rocker arm which normally actuates the exhaust valve stem 56 is shown at 70.

The electrical control system includes conduit 72 which is interconnected between the solenoid valve 14 and multi-position switch 74, a fuel pump switch 76, a clutch switch 78, a dash switch 80, a circuit breaker 82, the vehicle battery 84 and ground 86. A diode 88 may be connected between the switches and ground 86 to avoid arcing which could damage the switches. The multi-position switch 74 allows the vehicle operator to select one or more retarder sections depending upon the level of retarding desired. The fuel pump switch 76 ensures that the fuel supply is diminished or interrupted whenever the retarder is operated so as to minimize back-firing of the engine. The clutch switch 78 disengages the retarder whenever the clutch is disengaged to prevent engine stalling while the dash switch 80 permits the vehicle operator to shut off the retarder, if desired.

The operation of the mechanism is as follows: When the solenoid valve 14 is energized, oil at lube pressure flows through the solenoid via passageways 12 and 16 into the control valve cylinder 18 thereby lifting the control valve 22 against the bias of compression spring 24. When the groove 26 on the control valve 22 is in register with passageway 38, oil will flow through check valve 34 and passageways 38 and 42 to fill the slave cylinder 40 and master cylinder 44 above the slave piston 46 and master piston 58. The oil at lube pressure will bring the master piston 58 into engagement with the adjusting screw mechanism 68 so that upward motion of the pushtube 64 will drive the master piston 58 upwardly. As the hydraulic pressure in the system increases, the check valve 34 will close and the slave piston 46 will be driven downwardly (as shown in FIG. 1) against the exhaust valve stem 56 thereby opening the exhaust valve.

It will be appreciated that the motion of the master piston 58 will follow precisely the motion of the pushtube 64 which, in turn, will be precisely determined by the engine cam with which the pushtube 64 is associated. Similarly, once the retarder mechanism is filled with oil, the slave piston 46 will move in response to the motion of the master piston 58 since the oil in the system is essentially incompressible. If the diameters of the master piston and the slave piston are the same, thus providing an hydraulic ratio of 1.0, each increment of upward motion of the master piston will produce an equal increment of downward motion, of the slave piston. However, it is necessary to provide some clearance, or lash, in the exhaust valve train to ensure that the exhaust valves close completely during the powering mode of engine operation. This results from the fact that as the engine heats up during a powering mode, portions of the exhaust valve train, particularly the stem of the exhaust valves, increase in length. To accommodate this, it is customary to provide a clearance, or lash, of about 0.018 inch in the exhaust valve train when the engine is cold. This clearance may be set by appropriate adjustment of the adjusting screw 52.

It will be appreciated that the necessary clearance or lash in the exhaust valve train results in a delay in the opening of the exhaust valve when the engine is operating in the retarding mode of operation. In order to overcome this problem, the art developed a timing advance mechanism which is disclosed in Custer U.S. Pat. No. 4,398,510. In the Custer patent, the adjusting screw 52 was modified so as to provide a fixed, predetermined extension whenever the retarding mode of engine operation was selected. This effectively reduced the clearance or lash from the nominal value of 0.018 inch to some selected lesser value which could be zero or a negative amount.

While the mechanism disclosed in the Custer patent produced improved results, particularly at high engine speeds, applicant has discovered that a fixed timing advance does not maximize the retarding horsepower at lower engine speeds. In view of the current practice of operating engines at lower speeds to improve fuel economy it became important to develop a mechanism and process whereby the timing advance during retarding could be increased at lower engine operating speeds. A mechanism which accomplishes this goal is shown in FIGS. 2–5. Parts which are common to the mechanism shown in FIG. 1 are identified by the same designation.

In the improved mechanism, the slave piston 90 is provided with a central hole 92. An intermediate free piston 94 having an axial stop 96 is mounted for reciprocating motion within the slave piston 90. The axial stop 96 is lap fitted with the hole 92 so as to minimize leakage therethrough. However axial leakage grooves 95 are provided in the outer surface of intermediate piston 94 to drain off oil which may leak past the stop 96. An inner piston 97 is mounted for reciprocating limited motion within the intermediate piston 94. Downward motion (as viewed in FIGS. 2–5) of the inner piston 97 relative to the slave piston 90 is limited by the snap ring 98. Drain holes 99 are provided in the flange of the inner piston 97 to allow for leakage. A relatively light compression spring 100 is seated between the slave piston 90 and the intermediate piston 94 to bias said pistons away from each other. A relatively heavy biasing means 102 is positioned between the slave piston 90 and the intermediate piston 94 so as to provide a predetermined clearance 104 when the biasing means 102 is under no load, the axial stop 96 of the intermediate piston 94 is seated against the adjusting screw 52 and the inner piston 97 is in abutment both with the intermediate piston 94 and the snap ring 98. The intermediate piston 94 contains an axial through bore 106 and a check valve chamber 108. An axial blind bore 110 is formed in the head of the inner piston 97 in registry with the bore 106 and functions as a seat for check valve spring 112 which biases the check valve 114 against a seat in the check valve chamber 108.

As noted above, the slave piston 90 may act against a crosshead 116 slidably mounted on a pin 118 affixed to the engine head 120. Conventional dual exhaust valves 122 having stems 124 may be mounted in the engine head 120 and biased toward the closed position by valve springs 126.

When the engine retarder is in the "off" position as shown in FIG. 2 and the engine is cold, the clearance 128 in the exhaust valve train may be set to the desired value by means of the adjusting screw 52. This value may be, for example, 0.018 inch.

In order that the operation of the present invention may be more clearly defined, design information relating to the engine to which the retarder is attached must be considered. The engine under consideration was a Cummins 14 liter six cylinder diesel engine, Model 91N14CELECT. For this engine it was assumed that the allowable load on the pushtubes (providing for an appropriate safety factor) was 3000 pounds. Since the pushtubes are the weakest link in the valve train mechanism, the retarder would not overload any part of the engine if, over the full range of engine speeds, the loading of the pushtubes did not exceed the allowable load of 3000 pounds. Of course, the allowable load may vary from engine to engine and, for each engine, may be modified from time to time by the manufacturer, but, in each case, it is a known value. Applicant performed dynamometer tests on the Cummins 14 liter engine, measuring the retarding horsepower, the housing pressure and the pushtube loading throughout the operating speed range of the engine (1100 to 2100 rpm) while varying the predetermined clearance or lash in increments of 0.003" from a positive clearance of 0.006" to a negative clearance of −0.006". A negative clearance means that, during retarding, the exhaust valves are held open an amount equal to the negative clearance. The results of these tests are set forth in Table 1, below.

TABLE 1

| RPM | Clearance (IN) | Pushtube Load (Pounds) | Housing Pressure (psi) | Retarding HP |
|---|---|---|---|---|
| 1100 | +.006 | 1400 | 1900 | 112.5 |
| 1300 | +.006 | 1800 | 2200 | 157.9 |
| 1500 | +.006 | 2500 | 3200 | 231.0 |
| 1700 | −.006 | 3600 | 4200 | 309.0 |
| 1100 | +.003 | 1800 | 2300 | 110.5 |
| 1300 | +.003 | 2200 | 2600 | 153.5 |
| 1500 | +.003 | 3100 | 3900 | 279.7 |
| 1700 | +.003 | 4000 | 5200 | 303.0 |
| 1100 | 0.000 | 1600 | 2100 | 106.8 |
| 1300 | 0.000 | 2000 | 2500 | 149.6 |
| 1500 | 0.000 | 2800 | 2600 | 224.5 |
| 1700 | 0.000 | 3800 | 4600 | 301.7 |
| 1900 | 0.000 | 3800 | 5200 | 382.0 |
| 1100 | −.003 | 1400 | 1700 | 95.1 |
| 1300 | −.003 | 1800 | 2000 | 130.7 |
| 1500 | −.003 | 2300 | 2600 | 189.3 |
| 1700 | −.003 | 2900 | 3100 | 264.1 |
| 1900 | −.003 | 3000 | 4100 | 347.2 |
| 2100 | −.003 | 4000 | 5000 | 435.2 |
| 1100 | −.006 | 1200 | 1300 | 74.5 |
| 1300 | −.006 | 1500 | 1700 | 105.0 |
| 1500 | −.006 | 1800 | 2000 | 149.4 |
| 1700 | −.006 | 2200 | 2600 | 204.0 |
| 1900 | −.006 | 2400 | 3200 | 285.0 |
| 2100 | −.006 | 3000 | 3800 | 398.5 |

From the data in Table 1 it is apparent that a negative clearance of 0.006 inch is desirable at maximum engine speed in order that the retarding horsepower be maximized without exceeding the allowable pushtube lading. However, if this clearance is maintained throughout the engine speed range it is apparent that a substantial loss of retarding horsepower occurs at lower engine speeds. Accordingly it is apparent that it would be desirable to provide a mechanism for automatically varying the clearance over the operating speed range of the engine. Applicant's mechanism and process accomplish this desired result.

Figure 7:
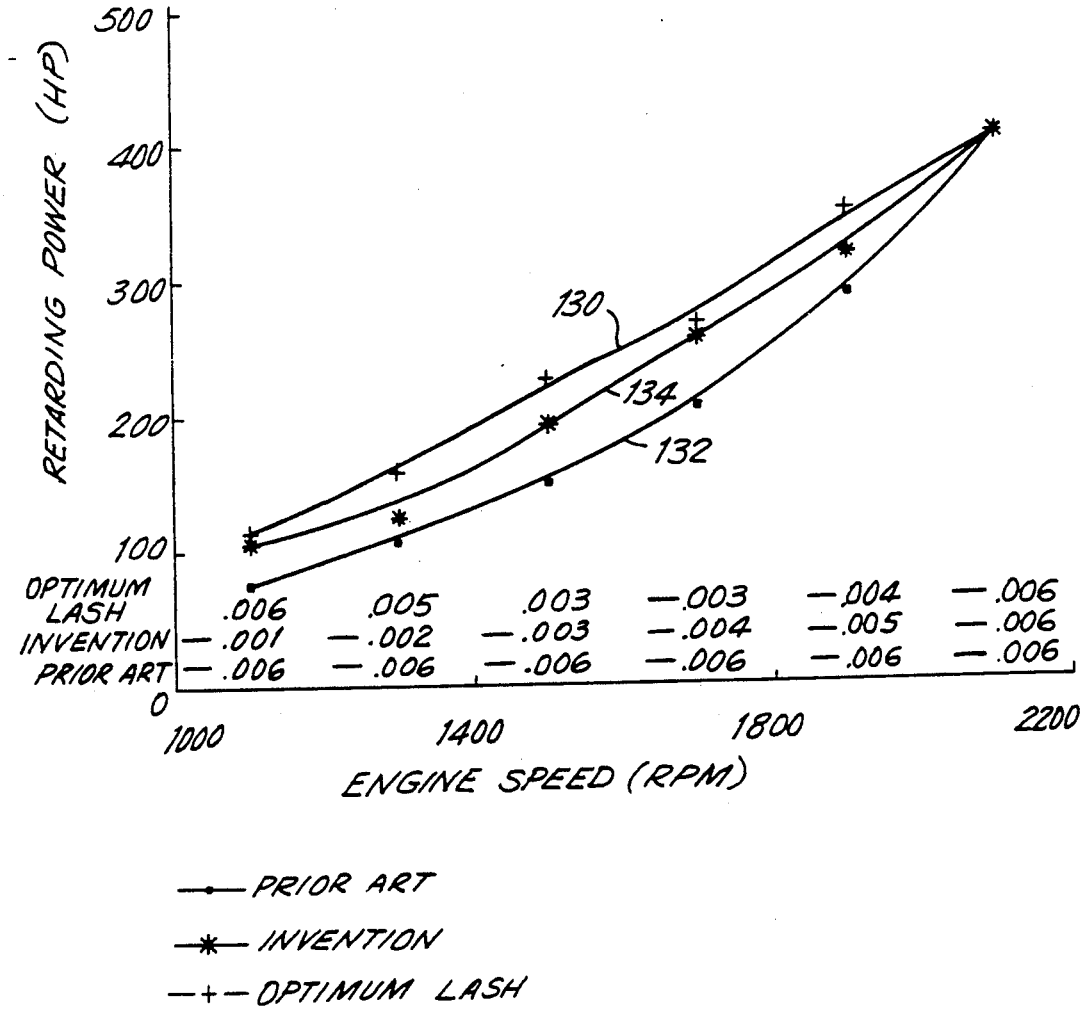
FIG. 7 is a graph of engine speed and retarding horsepower for an engine equipped with a Jacobs fixed timing advance mechanism and, alternatively, with a Jacobs variable timing advance mechanism according to the present invention.

Applicant has discovered, as shown by the data in Table 1 that the pushtube loading is proportional to the housing pressure and both are directly proportional to the engine speed but inversely proportional to the clearance. Consequently, housing pressure may be employed as a control to adjust clearance. The data also shows that the housing pressure varies from a minimum of 1900 psi at 1100 rpm and +0.006 clearance to a maximum of 3800 psi at 2100 rpm and −0.006 clearance. The optimum values of the clearance or lash are shown by optimum curve 130 on FIG. 7 which plots the retarding horsepower against engine speed for a retarder fitted on the Cummins 14 liter engine when the lash is varied between +0.006 and −0.006 inch over the operating speed range of the engine. Curve 132 on FIG. 7 is a plot of the retarding horsepower versus engine speed for the retarder when equipped with a fixed lash adjustment of −0.006 inch in accordance with the prior art Custer U.S. Pat. No. 4,398,510. Curve 134 is a plot of retarding horsepower against engine speed in accordance with the present invention where, for example, the lash is varied automatically from −0.006 to −0.001 inch. As will be explained in more detail below, the curve 134 can be designed to approach curve 130 as the deflection of the biasing means 102 approaches 0.012 inch over the range of housing pressures experienced during the operating speed range of the engine. It will be apparent that the biasing means 102 may be a mechanical spring, such as a stack of Belleville washers, a series of wave washers, a coil spring, an elastomeric member made from natural or synthetic rubber or other polymeric material or a gas or liquid contained in a diaphragm having an appropriate bulk modulus which produces the desired deflection in response to a change in housing pressure. Thus the present invention contemplates the process of appropriately modifying the lash in the exhaust valve train in response to a change in housing pressure and various mechanical biasing means by which this effect may be produced.

Figure 6:
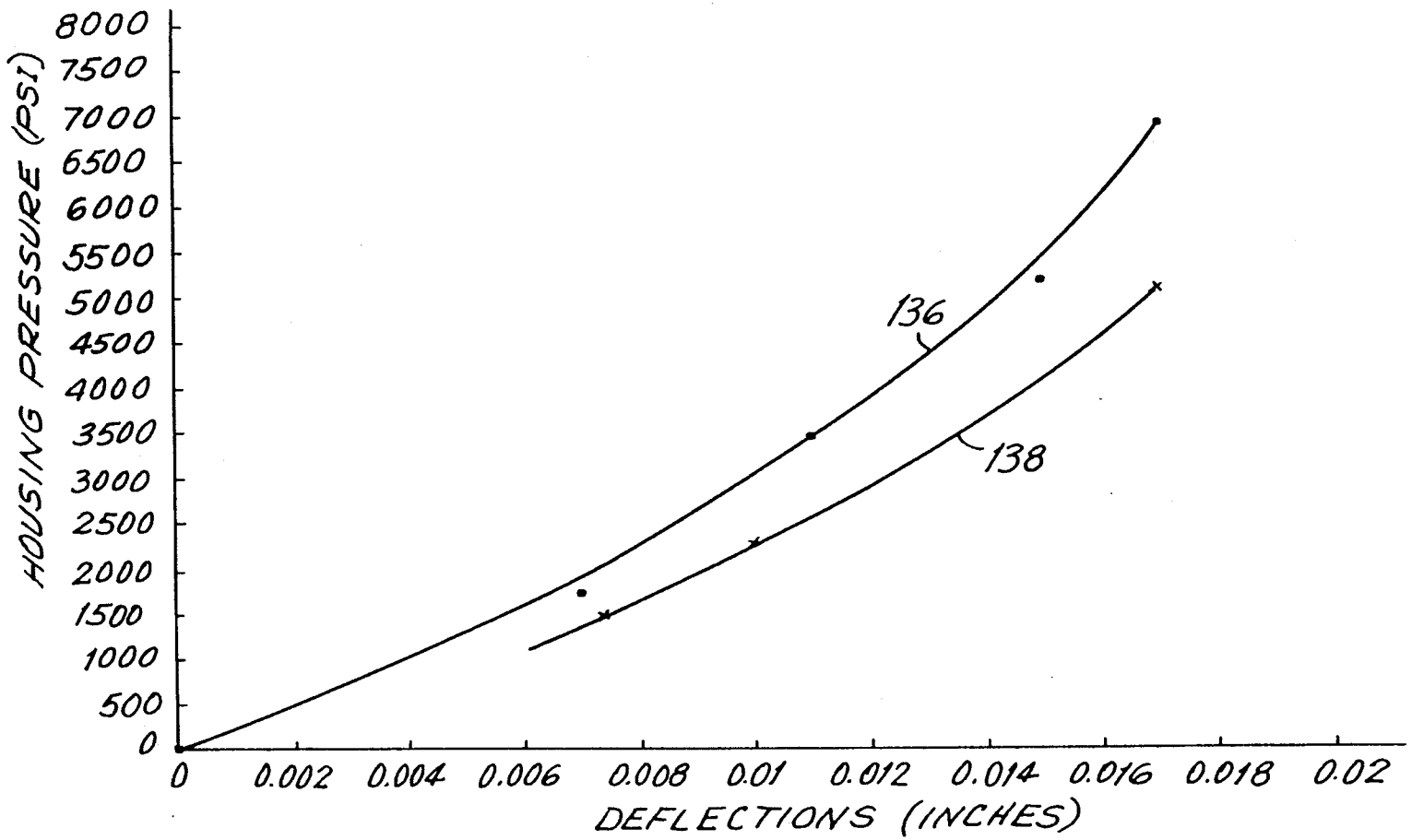
FIG. 6 is a graph showing the deflection of a biasing means as a function of the housing pressure.

As shown in FIG. 2, Applicant has chosen to exemplify the present invention by the use of a biasing means 102 which comprises a group of standard commercially available Belleville washers which has a deflection curve as exemplified by curve 136 on FIG. 6 which is a plot of housing pressure versus deflection. As shown by curve 136, a stack of 4 Belleville washers produced a deflection of about 0.005 inch over a pressure range of 2000 to 4000 psi. It is apparent, as shown by curve 138 which relates to a stack of 3 of the 4 Belleville washers utilized for curve 136 that a somewhat greater deflection, i.e., 0.0055 inch, can be produced over the same operating pressure range. Those skilled in the art will be able to select other form of biasing means which will produce even greater deflections over the housing pressure ranges which may be encountered with particular engines in order to more nearly approximate the optimum timing advance for the particular engine and retarder combination under consideration.

Considering now the Cummins engine/retarder system shown in FIGS. 2–5, the clearance 128 is preferably 0.018 inch and the clearance 104 is selected to be 0.012 inch in order to accommodate the deflection characteristics of the biasing means 102 as set forth in FIG. 6. This will be explained in more detail with reference to FIGS. 3, 4 and 5.

Figure 3:
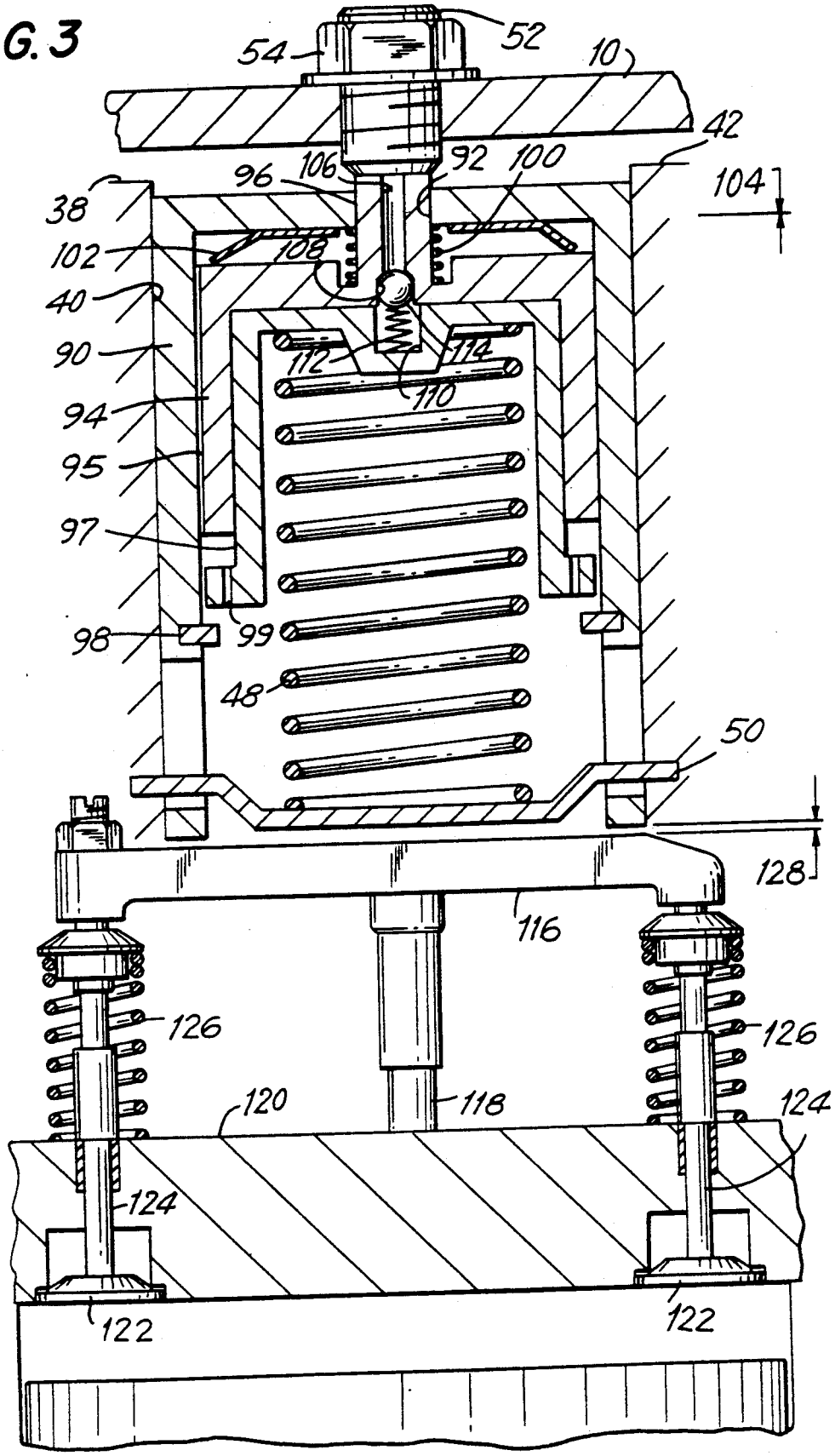
FIG. 3 shows the mechanism of FIG. 2 when the compression release retarder has been turned "on" and the housing pressure is at the pressure produced by the engine oil circulating pump.

Turning now to FIG. 3 which illustrates the mechanism of FIG. 2 when the retarder is turned "on" by energizing the solenoid 14 (FIG. 1), the parts are identified by the same designations as were used for FIG. 2. In this circumstance, low pressure oil from the engine lube system enters the slave cylinder 40 through passageway 38 at a pressure of 30–60 psi. This pressure is sufficient to compress the compression spring 100 so that the slave piston 90 is moved downwardly so as to eliminate the clearance 104 and reduce the clearance 128 from 0.018" to 0.006". However, the lube pressure is insufficient to cause deflection of either the slave piston spring 48 or the biasing means 102 and the axial stop 96 will remain sealed against the adjusting screw 52 but extend 0.012 inch above the top of the slave piston 90. Accordingly, the exhaust valves remain closed.

Figure 4:
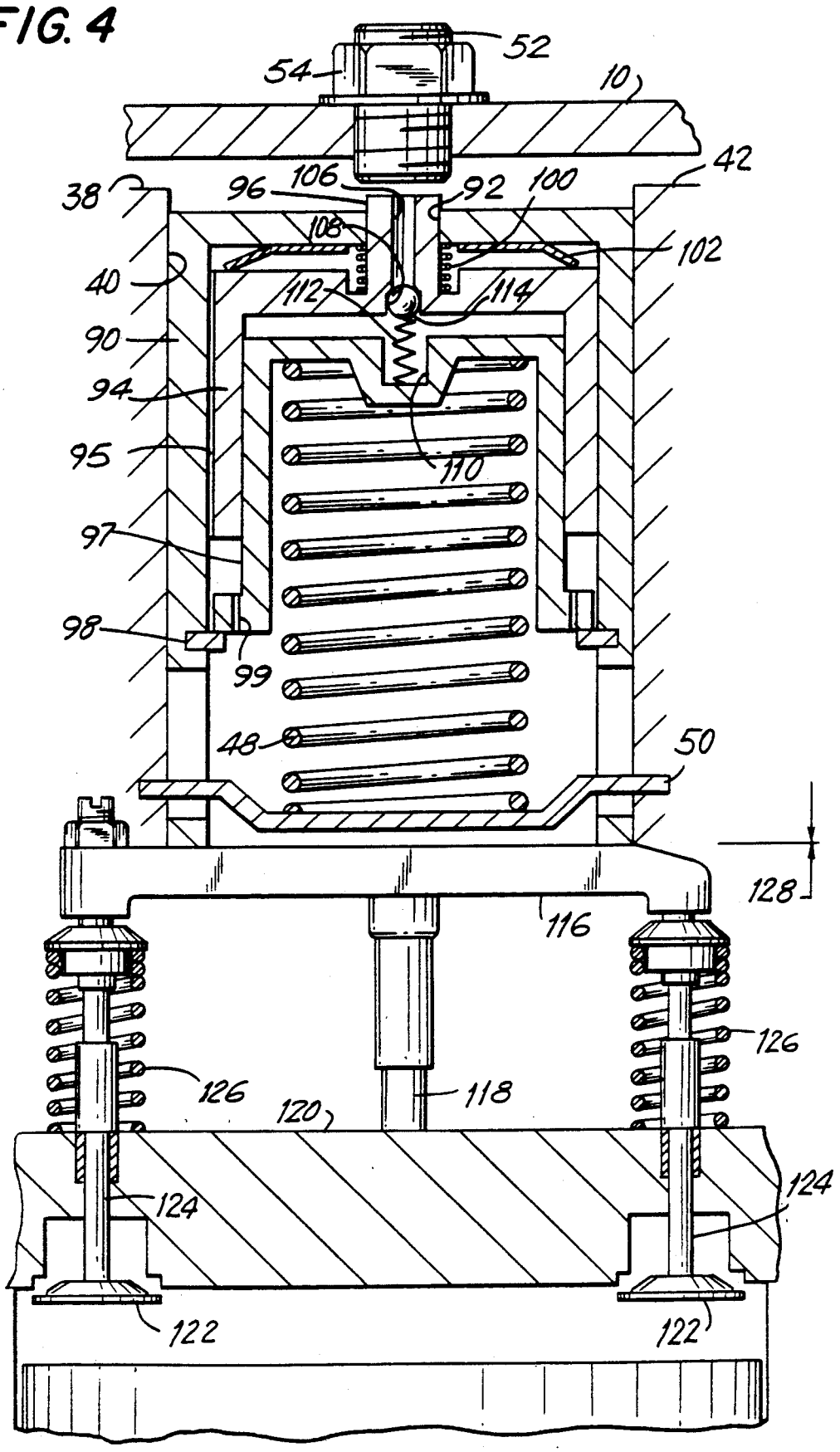
FIG. 4 shows the mechanism illustrated in FIGS. 2 and 3 with the parts in the positions they will assume when the housing pressure is at an intermediate level.

Reference is now made to FIG. 4 which shows the mechanism at an intermediate housing pressure range above about 2000 psi but below 4000 psi. As the pressure rises, due to the motion of the master piston 58 (FIG. 1), the slave piston 90 will move downwardly compressing the slave piston spring 48 so as to reduce the clearance 128 to zero and move the axial stop 96 away from the adjusting screw 52 thereby permitting oil to flow into bore 106 and past check valve 114. This causes the inner piston 97 to move downwardly (as shown in FIG. 4) until it contacts the snap ring 98. Thereafter the housing pressure will cause a corresponding deflection of the biasing means 102 (as shown by FIG. 6) while opening the exhaust valves against the engine cylinder pressure and the bias of the exhaust valve springs 126. The deflection of the biasing means 102 causes the axial stop 96 to protrude above the top of the slave piston 90 by an amount equal to 0.012 plus the deflection of the biasing means 102. As noted above, the housing pressure is proportional to the cylinder pressure which is, in turn, proportional to the engine speed. Thus, the actual protrusion of the axial stop 96 will be determined by the engine speed. When the master piston 58 begins to retract so as to cause the housing pressure to decrease, the check valve 114 will close thereby trapping oil between the inner piston 97 and the intermediate piston 94 so as to set the timing advance applicable to the next engine cycle. A controlled clearance is maintained between the inner piston 97 and the intermediate piston 94 so that a controlled leakage occurs between these pistons. This leakage may be replaced through the check valve 114 on the next engine cycle if the engine speed remains constant. If the engine speed decreases, the leakage will not be replaced until a new equilibrium position of the pistons 97 and 94 is attained. On the other hand, if engine speed is increased additional oil will flow past check valve 114 so as to increase the protrusion of the axial stop 96 proportional to the new engine speed.

Figure 5:
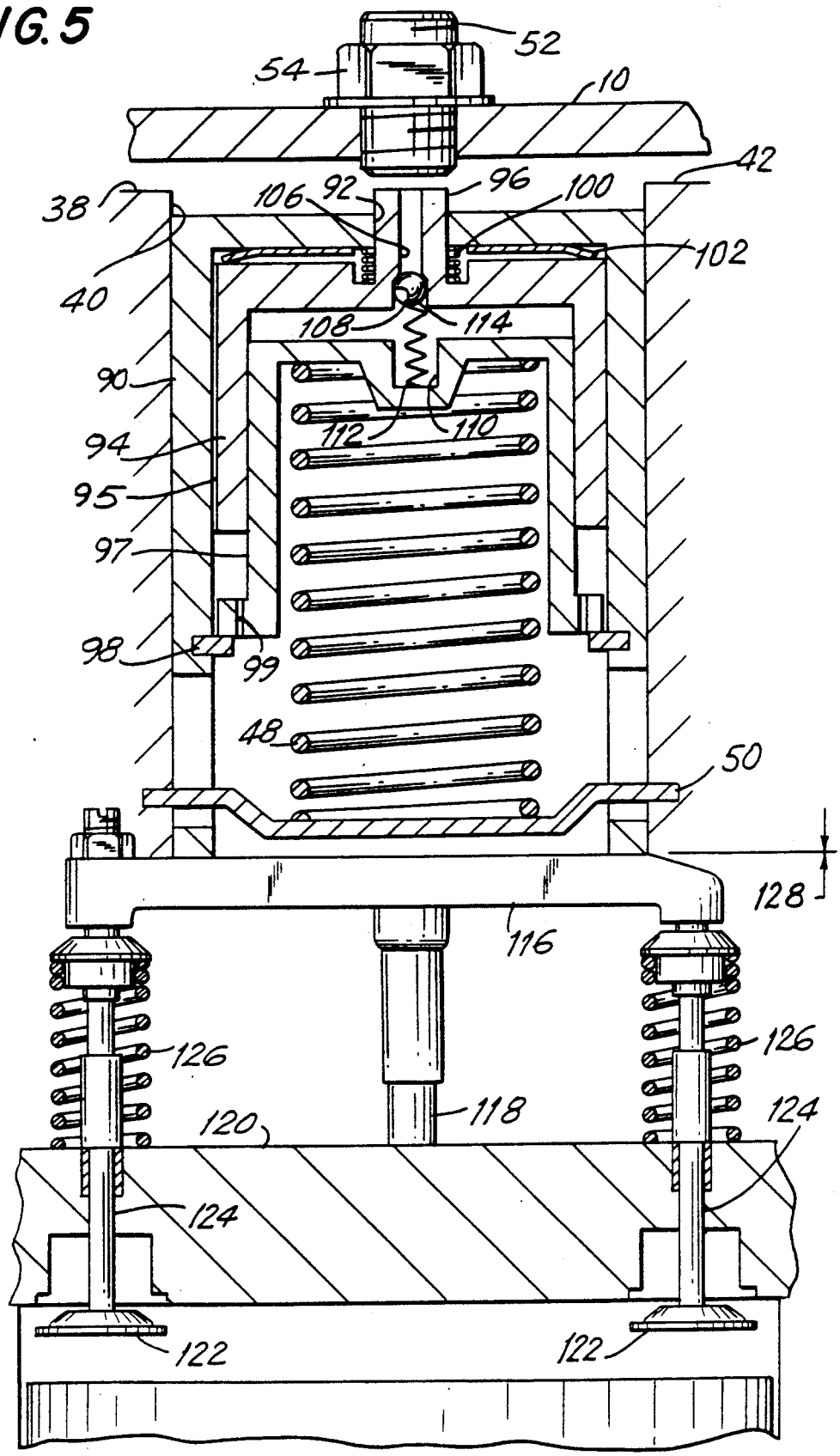
FIG. 5 shows the mechanism illustrated in FIGS. 2, 3 and 4 with the parts in the positions they will assume when the housing pressure is at a high level.

FIG. 5 illustrates the position of the mechanism at maximum engine speed where the housing pressure has attained its maximum level and the biasing means has been deflected to its maximum extent. As shown by FIG. 5, the axial stop 96 has also attained its maximum protrusion so that maximum timing advance has been attained for purposes of engine retarding. Under these conditions there may be a negative clearance in the exhaust valve train so that the exhaust valves are held in a partially open position or there may be zero clearance or a small positive clearance. The actual clearance is a function of the design of the engine, the optimum clearance, and the degree to which the biasing means approaches the optimum design. It will be apparent to those skilled in the art that the principal design criteria are the load carrying limitations of the engine valve train mechanism, a matter under the control of the engine manufacturer, and the characteristics of the biasing means 102.

Applicant prefers the use of Belleville washers for the biasing means 102 because such washers are simple, reliable, compact and commercially available. However, it is recognized that other biasing means may be employed.

Figure 8:
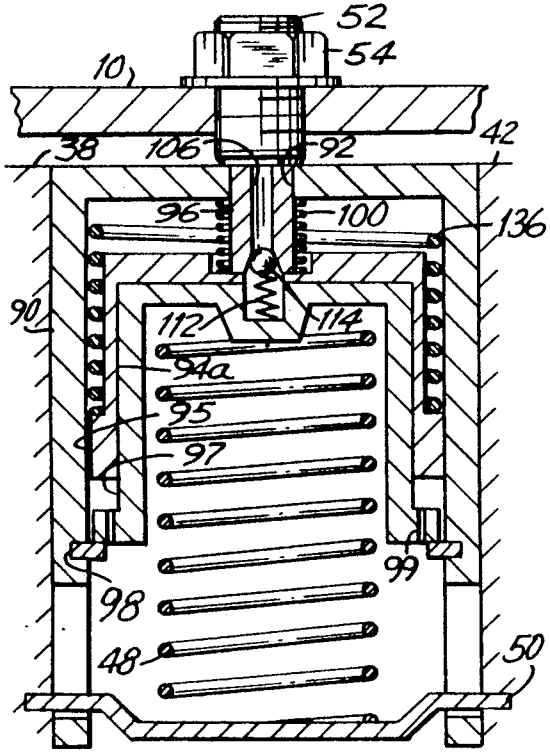
FIG. 8 shows a modification of the mechanism shown in FIGS. 2–5 wherein the biasing means is a coil spring.

FIG. 8 shows a modified design of the slave piston mechanism in which a coil spring 136 is interposed between the slave piston 90 and the intermediate piston 94*a*. With this design a greater deflection is contemplated over the range of operating pressure range so as to approach the optimum positive clearance at minimum engine speeds.

Figure 9:
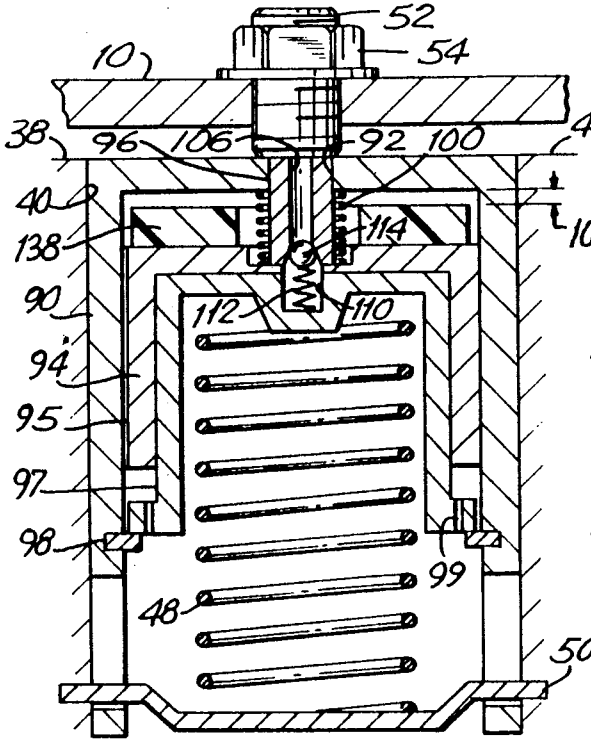
FIG. 9 shows a further modification of the mechanism shown in FIGS. 2–5 wherein the biasing means is an elastomeric element.

FIG. 9 shows a further modified design of the biasing means in which a disc 138 of an elastomeric material such as natural or synthetic rubber deflects under the effect of the housing pressure in the manner of a spring. The elastomeric material must be capable of withstanding the conditions of temperature and pressure as well as being impervious to oil and capable of operating for an indefinite period without aging.

Figure 10:
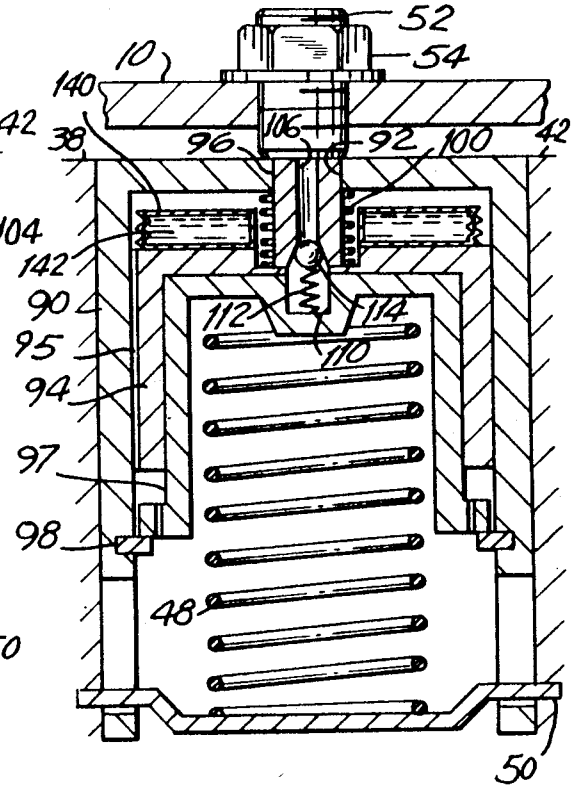
FIG. 10 shows a still further modification of the mechanism shown in FIGS. 2–5 wherein the biasing means is a gas or liquid-containing diaphragm.

FIG. 10 shows a still further modified design incorporating a diaphragm 140 containing a gas or liquid 142 having a bulk modulus such that it functions as a spring having appropriate deflection characteristics as set forth above.

It will now be appreciated that the slave piston mechanisms described herein are adapted to provide a process for compression release retarding in which, when the engine is operated in the retarding mode, the valve timing is automatically varied in response to housing pressure as a function of engine speed so as to provide maximum retarding horsepower over the operating range of engine speeds without exceeding the allowable loading on the valve train mechanism. The process and mechanisms of the present invention are applicable to compression release retarders driven from the exhaust valve cam, the intake valve cam or the fuel injector cam of an engine. The invention may be applied to compression release retarders of both the so-called four cycle and two cycle types, i.e., retarders that produce one compression release event per cylinder for each engine cycle or those that produce two compression release events per cylinder for each engine cycle.

The terms and expressions which have been employed are used as terms of description and not of limitation, and there is no intention in the use of such terms and expressions of excluding any equivalents of the features shown and described or portions thereof, but it is recognized that various modifications are possible within the scope of the invention claimed.

What is claimed is:

1. In an engine retarding system of a gas compression release type including an internal combustion engine having a pressurized lubricating oil system, intake valve means, exhaust valve means and pushtube means associated with each of said intake valve means and said exhaust valve means, hydraulically actuated slave piston means associated with said exhaust valve means to open said exhaust valve means, adjusting means adapted to limit the travel of said slave piston means, control valve means and solenoid means communicating in series with said pressurized lubricating oil system and said hydraulically actuated slave piston means, master piston means driven from said pushtube means associated with one of said intake and said exhaust valve means and hydraulically interconnected with said slave piston means, the improvement comprising a variable timing means incorporated in said slave piston means and responsive to the hydraulic pressure acting on said slave piston means, said variable timing means comprising an intermediate piston means mounted for reciprocating motion within said slave piston means and having stop means adapted to extend through said slave piston means and abut against said adjusting means when said master piston is in a retracted position, said stop means having a bore formed therethrough, inner piston means mounted for limited reciprocating motion with respect to said intermediate piston means and said slave piston means, a check valve communicating with said bore of said stop means to permit flow of oil through said bore toward said inner piston means, first biasing means adapted to bias said intermediate piston means away from said slave piston means and second biasing means positioned between said slave piston means and said intermediate piston means and responsive to the hydraulic pressure above said slave piston means whereby the extension of said stop means through said slave piston means is proportional to the hydraulic pressure above said slave piston means.

2. An apparatus as set forth in claim 1 in which said second biasing means comprises at least one Belleville washer.

3. An apparatus as set forth in claim 1 in which said second biasing means comprises at least one wave washer.

4. An apparatus as set forth in claim 1 in which said second biasing means comprises a coil spring.

5. An apparatus as set forth in claim 1 in which said second biasing means comprises an elastomeric disc.

6. An apparatus as set forth in claim 5 in which said elastomeric disc is formed from synthetic rubber material.

7. An apparatus as set forth in claim 5 in which said elastomeric disc is formed from a polymeric material.

8. An apparatus as set forth in claim 1 in which said second biasing means comprises a gas-filled diaphragm.

9. An apparatus as set forth in claim 1 in which said second biasing means comprises a liquid-filled diaphragm.

10. In an engine retarding system of a gas compression release type including an internal combustion engine having a pressurized lubricating oil system, intake valve means, exhaust valve means, fuel injector means and pushtube means associated with each of said intake valve means, said exhaust valve means and said fuel injector means, hydraulically actuated slave piston means associated with said exhaust valve means to open said exhaust valve means, adjusting means adapted to limit the travel of said slave piston means, control valve means and solenoid means communicating in series with said pressurized lubricating oil system and said hydraulically actuated slave piston means, master piston means driven from said pushtube means associated with one of said intake valve means, said exhaust valve means and said fuel injector means and hydraulically interconnected with said slave piston means, the improvement comprising a variable timing means incorporated in said slave piston means and responsive to the hydraulic pressure acting on said slave piston means, said variable timing means comprising an intermediate piston means mounted for reciprocating motion within said slave piston means and having stop means adapted to extend through said slave piston means and abut against said adjusting means when said master piston is in a retracted position, said stop means having a bore formed therethrough, inner piston means mounted for limited reciprocating motion with respect to said intermediate piston means and said slave piston means, a check valve communicating with said bore of said stop means to permit flow of oil through said bore toward said inner piston means, first biasing means adapted to bias said intermediate piston means away from said slave piston means and second biasing means positioned between said slave piston means and said intermediate piston means and responsive to the hydraulic pressure above said slave piston means whereby the extension of said stop means through said slave piston means is proportional to the hydraulic pressure above said slave piston means.

11. An apparatus as set forth in claim 10 in which said second biasing means comprises at least one Belleville washer.

12. An apparatus as set forth in claim 10 in which said second biasing means comprises at least one wave washer.

13. An apparatus as set forth in claim 10 in which said second biasing means comprises a coil spring.

14. An apparatus as set forth in claim 10 in which said second biasing means comprises an elastomeric disc.

15. An apparatus as set forth in claim 14 in which said elastomeric disc is formed from a synthetic rubber material.

16. An apparatus as set forth in claim 14 in which said elastomeric disc is formed from a polymeric material.

17. An apparatus as set forth in claim 10 in which said second biasing means comprises a gas-filled diaphragm.

18. An apparatus as set forth in claim 10 in which said second biasing means comprises a liquid-filled diaphragm.

19. A process for compression release retarding of a cycling multi-cylinder four cycle internal combustion engine having a crankshaft and an engine piston operatively connected to said crankshaft for each cylinder thereof and having intake and exhaust valves and intake and exhaust pushtubes for each cylinder thereof, said engine having, in addition, an hydraulic slave piston and cylinder associated with each exhaust valve, an hydraulic master piston and cylinder associated with at least one of said intake and exhaust pushtubes, and a timing advance mechanism including an intermediate piston mounted for reciprocating motion within said slave piston, an inner piston mounted for limited reciprocating motion with respect to said intermediate piston and said slave piston, biasing means incorporated between said slave piston and said intermediate piston and stop means in said slave piston moveable relative to said slave piston in response to said biasing means comprising, for at least one cylinder thereof, the steps of reducing the flow of fuel to said cylinder, increasing the hydraulic pressure in the slave cylinder above the slave piston by driving said master piston by said pushtube, adjusting the relative positions of said slave piston, said intermediate piston and said inner piston in response to said increased hydraulic pressure, compressing said biasing means in response to the movement of said slave piston, said intermediate piston and said inner piston, adjusting the position of said stop means in response to the compression of said biasing means, and continuously readjusting the position of said stop means whereby the timing advance of said slave piston is proportional to the hydraulic pressure above said slave piston in said slave cylinder.

20. A process for compression release retarding of a cycling multi-cylinder four cycle internal combustion engine having a crankshaft and an engine piston operatively connected to said crankshaft for each cylinder thereof and having a fuel injector, intake valves and exhaust valves and fuel injector pushtubes, intake valve pushtubes and exhaust vale pushtubes for each cylinder thereof, said engine having, in addition, an hydraulic slave piston and cylinder associated with each exhaust valve, an hydraulic master piston and cylinder associated with at least one of said fuel injector, intake valve and exhaust valve pushtubes, and a timing advance mechanism including an intermediate piston mounted for reciprocating motion within said slave piston, an inner piston mounted for limited reciprocating motion with respect to said intermediate piston and said slave piston, biasing means incorporated between said slave piston and said intermediate piston and stop means in said slave piston moveable relative to said slave piston in response to said biasing means comprising, for at least one cylinder thereof, the steps of comprising, for at least one cylinder, increasing the hydraulic pressure in the slave cylinder above the slave piston by driving said master piston by said pushtube, adjusting the relative positions of said slave piston, said intermediate piston and said inner piston in response to said increased hydraulic pressure, compressing said biasing means in response to the movement of said slave piston, said intermediate piston and said inner piston, adjusting the position of said stop means in response to the compression of said biasing means, and continuously readjusting the position of said stop means whereby the timing advance of said slave piston is proportional to the hydraulic pressure above said slave piston in said slave cylinder.

* * * * *

UNITED STATES PATENT AND TRADEMARK OFFICE

CERTIFICATE OF CORRECTION

PATENT NO. : 5,048,480

DATED : September 17, 1991

INVENTOR(S) : Robert B. Price

It is certified that error appears in the above-indentified patent and that said Letters Patent is hereby corrected as shown below:

Column 6, line 6, Delete the comma.

Column 7, line 50, In the line for 1700 RPM change "-.006" to --+.006--.

Column 8, lines 4-5, Change "lading" to --loading--.

Column 8, line 65, Change "form" to --forms--.

Column 14, lines 9-10, Change "comprising, for at least one" to --reducing the flow of fuel to said--.

Signed and Sealed this

Ninth Day of May, 1995

Bruce Lehman

*Attest:*

BRUCE LEHMAN

*Attesting Officer*

*Commissioner of Patents and Trademarks*